US005215210A

United States Patent [19]

Ostrum et al.

[11] Patent Number: 5,215,210

[45] Date of Patent: Jun. 1, 1993

[54] MOLDED PLASTIC PAIL WITH INTEGRALLY FORMED BAIL

[75] Inventors: James V. Ostrum, St. Paul; Kenneth G. Weller, Minneapolis, both of Minn.

[73] Assignee: Liberty Diversified Industries, New Hope, Minn.

[21] Appl. No.: 869,450

[22] Filed: Apr. 16, 1992

[51] Int. Cl.[5] ..... B65D 23/60

[52] U.S. Cl. ..... 220/754; 220/771

[58] Field of Search ..... 220/91, 97 A, 657, 659, 220/754, 771; 220/754, 771

[56] References Cited

U.S. PATENT DOCUMENTS

| | | | |
|---|---|---|---|
| 3,207,298 | 9/1965 | Wilson | 220/94 R |
| 3,220,626 | 11/1965 | Tupper | 220/94 R |
| 3,310,088 | 3/1967 | Hilderbrandt et al. | 150/0.5 |
| 3,717,277 | 2/1973 | Stengle, Jr. | 220/94 R X |
| 3,730,382 | 5/1973 | Heisler | 220/60 R |
| 3,889,732 | 6/1975 | Wilkins | 150/48 |
| 3,977,563 | 8/1976 | Holt | 220/306 |
| 4,357,042 | 11/1982 | Gall | 294/31.2 |
| 4,380,304 | 4/1983 | Anderson | 220/306 |
| 4,881,658 | 11/1989 | VanCucha | 220/306 |
| 4,997,098 | 3/1991 | Buza et al. | 220/91 |
| 5,027,973 | 7/1991 | Drogos | 220/91 X |

*Primary Examiner*—Steven M. Pollard
*Attorney, Agent, or Firm*—Moore & Hansen

[57] ABSTRACT

A pail and bail in which the bail is molded integrally with the pail and includes a circular cross-section bead which extends around the pail coplanar with and spaced apart from the rim. The bead is connected to opposing sides of the pail either by a rib that has generally triangular fins which curve inwardly between two vertical flanges that project outwardly from the side wall of the pail, or by a single flange member that flares laterally outwardly and radially inward along a thin rectangular or flattened oval segment of the bail. When the handle segments of the bail are pivoted upwardly and inwardly toward one another to a position disposed above the open top of the pail, the entire bead forms a figure eight pattern with smoothly curving loops without creases or fold lines. The components connecting the bail to the pail will flex inwardly when the pail is loaded and supported by the bail. Tabs at the bottom of the flange members may interlock within recesses formed in the rim of the underlying pail to prevent rotation and facilitate separation. Ramps may be molded on the inner surface of the side wall to enhance denesting.

19 Claims, 2 Drawing Sheets

MOLDED PLASTIC PAIL WITH INTEGRALLY FORMED BAIL

BACKGROUND OF THE INVENTION

1. Field of the Invention

This invention relates generally to molded plastic pails, buckets and similar containers having pivotable handles, and particularly to such a container molded from a plastic and having an integrally formed pair of pivotable handle members.

2. Description of the Prior Art

Many types of molded plastic pails and buckets are old in the art. The most common type include a generally cylindrical or tapered cylindrical body, flat bottom, and an outwardly projecting peripheral rim surrounding the open top of the receptacle region. A handle or bail, usually of metal or plastic, extends in a generally uniform semicircular curve between opposing side walls of the pail or bucket and is pivotably connected at each end to the pail or bucket. The bail is normally attached to the pail or bucket by bending or crimping the ends of the bail and inserting them through apertures in a boss or flange adjacent to the rim. The ends of the bail may be further crimped, rounded, or capped to prevent the bail from disengaging from the apertures. Representative examples of this type of container and handle assembly are shown in U.S. Pat. No. 4,997,098 to Buza; U.S. Pat. No. 3,977,563 to Holt; and U.S. Pat. No. 4,881,658 to Van Cucha.

Various designs have been developed incorporating an integral or unitary bail with the molded plastic pail or bucket in order to overcome the disadvantages associated with assembly, or to overcome structural disadvantages inherent in conventional pails and buckets.

Representative examples of pails and buckets incorporating unitarily or integrally molded plastic bails are shown in U.S. Pat. No. 3,310,088 to Hildebrandt; U.S. Pat. No. 3,730,382 to Heisler; U.S. Pat. No. 4,357,042 to Gall; and U.S. Pat. No. 4,380,304 to Anderson. Each of these references discloses a container having one semicircular bail molded integrally with the container, and pivotably movable between a lowered position where the bail is substantially coplanar with the rim of the container and a raised position where the bail extends substantially vertically above the top of the container. The handles are either connected directly to the side walls of the pail or to molded lugs or bosses extending radially outward from the side walls. The handles are generally flat strips which crease at points or fold lines across which the handle may be pivoted upwardly, with some of the handles capable of twisting partially along their lengths as they are pivoted upwardly. Heisler '382 provides a bail with a substantially circular cross-section that twists longitudinally when pivoted upwardly, but which utilizes reinforcement fins or flanges directly adjacent to the side walls of the pail to prevent the bail from shearing upon excessive rotation or due to jerks or sudden pulls.

Another alternative method of forming an integrally molded pail bail is disclosed in U.S. Pat. No. 3,889,732 to Wilkins, which shows a pair of opposing semi-circular bails connected to the side walls of the pail by U-shaped lugs. The portions of the handles adjoining the lugs are flattened to provide a single crease point across which the handles will pivot upwardly, and are scored to form ligament hinges. The semi-circular bail segments are flattened to mate together throughout their entire length when both pivoted to their fully raised position above the pail.

Among the most notable disadvantages of the integrally molded pail bails discussed above are the formation of single crease points or fold lines required in order to permit the bails to be pivoted upwardly, and which also produce shear points along which the handle is substantially weakened and will tend to break unpredictably. These shear points will also lead to deterioration of the bail upon repeated use, and make the bails susceptible to failure when the pail is used in cold conditions or contains a frozen product. The use of a single flat handle which twists when pivoted upwardly or when a load is placed in the container increases the likelihood of handle breakage by further stressing any crease points or fold lines, and does not provide any backup if that single handle fails.

BRIEF SUMMARY OF THE INVENTION

It is therefore one object of this invention to design an integrally molded pail and bail in which the bail extends around the entire peripheral rim of the pail, and in which two handles portions of the bail may be pivoted upwardly to a position above the lid of the pail and gripped by a user without forming crease points or fold lines in the bail that reduce the structural integrity of the bail, or that will weaken or deteriorate with repeated use, in a cold environment, or if the pail contains a frozen product.

It is a further object of this invention to design the above pail and bail such that the bail may be spaced-apart a distance from the side walls of the pail, and the bail may be connected to the side wall in a manner that provides increased shock absorbing properties, without requiring the addition of excess material or molded portions adjacent to the side wall of the pail, and will further permit nesting of like pails in a vertical column without rotation or interference with conventional automated pail dispensing and filling machines.

It is yet another object of this invention to design the above pail and bail such that a minimum of material is utilized in forming the connection between the bail and the side walls of the pail, and such that the connection may be formed from generally uniform thin-walled components for which the molding and curing processes can be more readily controlled, and which will conform suitably to the molding and curing requirements for the remainder of the pail.

Briefly described, the pail and bail of this invention comprises a slightly tapered cylindrical pail that is nestable with like pails, having a circular bottom curving to an upwardly projecting cylindrical side wall, a radially offset segment proximate to the open top and extending downwardly approximately one quarter the height of the side wall, and an outwardly and downwardly extending peripheral rim. The bail is molded integrally with the pail, and includes a circular cross-section bead which extends around and coplanar with the circumference of the rim and is spaced apart therefrom a distance. In a first embodiment, the bead is connected to opposing sides of the side wall by two circular ribs that have outwardly flaring triangular fins on each side, the lowermost portion of the fins curving inwardly toward the side wall of the pail and disposed between two vertically oriented and spaced-apart flanges that extend outwardly from the side wall of the pail, the fins being connected to both an outwardly projecting portion of each flange located beneath the fins and to the inner side surfaces of the flanges. When the handle segments of the bail are pivoted upwardly and inwardly toward one another to a position contacting one another and disposed above the open top of the pail, the entire bead or bail will form a figure eight pattern without creasing or folding. The outwardly projecting portions of the flanges, fins, and ribs form a slight outward angle with the side wall of the pail such that when the pail is supported by the bail and weight is placed in the pail, the components connecting the bail to the pail will flex inwardly without creasing or folding. Ramps are disposed on the inner surface of the side wall along the height of the radially offset segment, and short beveled segments oriented orthogonally to the ramps and closely adjacent the bottom of the radially offset segment, to facilitate denesting the pails. In a second embodiment, the bail is connected to the side walls of the pail by opposing flange members that flare laterally outwardly and radially inward and are integrally formed with thin rectangular or flattened oval segments of the bail. When two or more pails are stacked in a vertical column, tabs at the bottom of each flange member interlock within recesses formed in the rim of the underlying pail to prevent rotation and facilitate separation.

DESCRIPTION OF THE PREFERRED EMBODIMENTS

The container of this invention is shown in FIGS. 1–11 and referenced generally therein by the numeral 10. The container 10 is preferably integrally molded as a unitary article from a thermoplastic formable resin such as white polyethylene.

Figure 1:
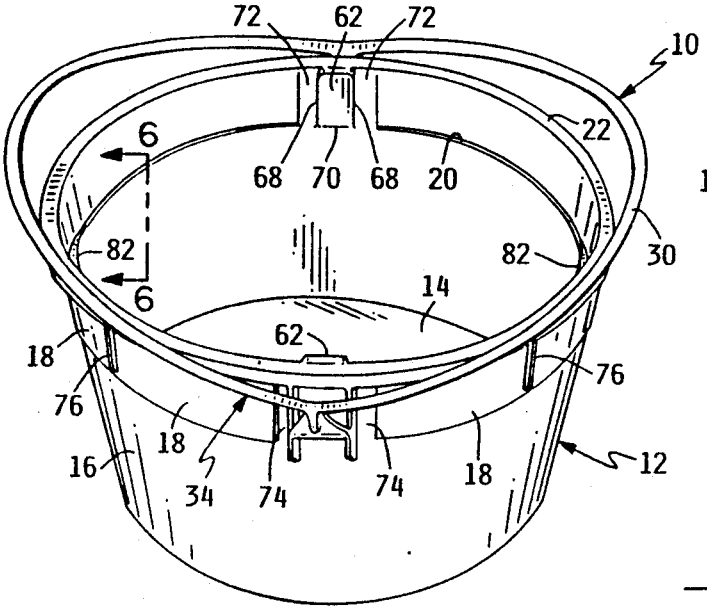
FIG. 1 is a perspective view of a first embodiment of the pail and bail of this invention with the handle segments of the bail disposed generally in the lowered position substantially coplanar with the rim of the pail.
Figure 3:
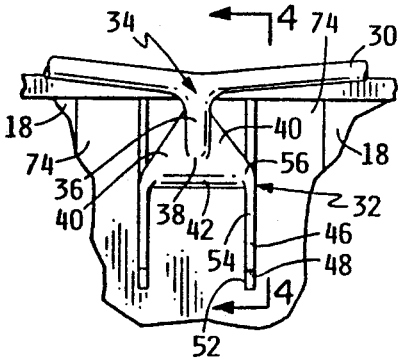
FIG. 3 is a detail side elevation view of the connecting components of the bail and adjacent portions of the pail taken from the front in FIG. 1.

Referring particularly to FIG. 1, it may be seen that a first embodiment of the container 10 comprises a pail body 12 having a generally circular bottom 14, an generally upright and cylindrical side wall 16 curving upward uniformly from the bottom 14 and having a slight outward taper such that like containers 10 may be nested in a vertical column within one another, a radially offset portion 18 of the side wall 1 which is disposed radially outside and circumscribing the top edge 20 of the lower portion of the side wall 16 a distance equal to the thickness of the material forming the side wall 16 and extending vertically along approximately one quarter the total height of the side wall 16, the radially offset portion 18 being located proximate to and below the top peripheral edge 22 of the side wall 16 from which a horizontal top rim member 24 extends outwardly and a vertically depending skirt portion 26 extends downwardly a distance from the side wall 16 to form a generally circular top peripheral rim 28 of the pail body 12.

A toroid-shaped bead 30 extends around and circumscribes the peripheral rim 28 of the pail body 12. The bead 30 preferably has a circular cross-section throughout with a constant cross-sectional diameter along the entire circumference thereof of slightly greater than approximately 0.125" and less than approximately 0.140", but at least throughout two portions proximate to and overlapping a pair of adjacent connecting members or connecting components 32. The bead 30 has an inside diameter of approximately 9.3125" inches such that the inner edge of the bead 30 is spaced apart from the outer surface of the skirt portion 26 a distance of approximately 0.375" along the length of the bead 30. The bead 30 is disposed substantially coplanar with the peripheral rim 28, and preferably with the top surface of the bead 30 being disposed slightly less than or equal to 0.125" below the top edge 22 of the side wall 16 or top surface of the horizontal top rim member 24.

Referring particularly to FIGS. 1 and 3–5, the bead 30 is connected to the side wall 16 of the pail body 12 in the region of the offset portion 18 by the pair of connecting components 32. The bead 30 and connecting components 32 together form a bail assembly or bail structure 34, with the bail structure 34 and pail body 12 together forming the container 10.

Two sets of the connecting components 32 are disposed between the pail body 12 and bail 14 on diametrically opposing sides of the pail body 12 from one another. Each of the connecting components 32 includes a generally circular rib member 36 formed integrally with and extending perpendicularly from the bead 30, the rib member 36 having a cross-sectional diameter substantially equal to the cross-sectional diameter of the bead 30, and a length of approximately 0.4375" measured between the bottom surface of the bead 30 and the lowermost point on the rounded bottom 38 of the rib member 36. The rib member 36 depends from the bead 30 generally parallel to the radially offset portion 18 of the side wall 16. Extending or flaring outwardly and downwardly from each side of the rib member 36 generally parallel with the radially offset portion 18 of the side wall 16 is a widened portion comprised of a pair of generally triangular fin members 40 which are connected together beneath the rounded bottom 38 of the rib member 36 by a bridge member 42, the bridge member 42 curving inwardly adjacent the bottom edge 44 thereof toward the radially offset portion 18 of the side wall 16. Each fin member 40 and the bridge member 42 has a thickness on the order of approximately 0.0625" or slightly less, which is generally on the order of two or less times the thickness of the material forming the side wall 16. The fin members 40 extend outwardly and rearwardly and connect with a pair of generally vertical flange members 46. Each flange member 46 has a generally rectangular shape in side view, extending approximately 0.25" outwardly from the radially offset portion 18 of the side wall 16 at the lower end 48 thereof and flush with the outer surface of the depending skirt portion 26 at the top end thereof. The lower end 48 of each flange member 46 is generally aligned with and disposed at the same height as the outer lowermost edge 50 of the radially offset portion 18 of the side wall 16, with each flange member 46 defining a rectangular stub 52 located at the lower edge 48 thereof generally coplanar with the flange member 46 and extending outwardly from the outer surface of the side wall 16 a distance approximately one quarter to one third of the lower edge 48 of the flange member 46. The flange members 46 each having a thickness of approximately 0.0625" or slightly less, and are spaced apart from one another a distance approximately equal to or slightly less than 0.6875". Each flange member 46 further defines an outwardly projecting member 54 in the general shape of an inverted triangle having an outwardly angled edge opposing the side wall 16 of the pail 12, the projecting members 54 forming a pair of connections with the lower portions of the fin members 40 forming a one quarter turn or twist 56 between the ends of the fin members 40 and the outwardly projecting members 54, with the bridge member 42 extending inwardly between and connected along the outer edges thereof to each of the flange members 46. The top edge 58 of each projecting member 54 is disposed behind the one quarter twist 56 forms an upwardly concave curve, with the connecting components 32 being angled slightly outward and away from parallel with the radially offset portion 18 of the side wall 16 between approximately 10° and 30° depending upon the expected maximum normal load for the container 10, such that the connecting components 32 will pivot or flex inwardly toward the radially offset portion 18 of the side wall 16 when a load is placed in the pail body 12 and supported by the bail structure 34 as shown in FIG. 2.

For a container 10 having an inner diameter of approximately 8" and a depth of approximately 5" or less, with a volume on the order of approximately 250 $in^3$ (4000 $cm^3$) or 1 gallon (4 liters), the normal load would be on the order of approximately 8.8 lbs. (4 kg.) or substantially less.

Figure 2:
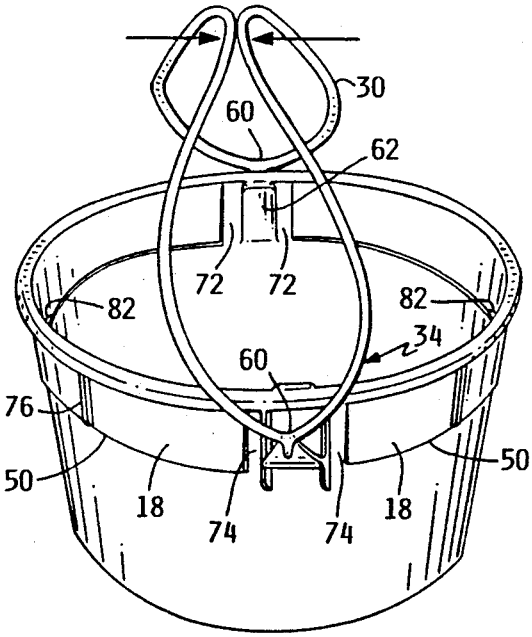
FIG. 2 is a perspective view of the pail and bail of FIG. 1 with the handle segments disposed generally in the raised position proximate to one another, with the bead substantially forming a figure eight pattern with smoothly curved loops proximate to the connecting members.

When the central handle or handgrip segments of the bead 30 are pivoted upwardly and inwardly toward one another to a position contacting one another and disposed above the open top of the pail body 12 as shown in FIG. 2, the entire bead 30 or bail structure 34 will generally form a figure eight pattern without creating sharp creases or folds in the bead 30, and presenting generally curved loops 60 at the ends or segments of the bead 30 adjacent to the connecting components 32. The figure eight pattern will remain substantially smooth without sharp creases, folds, or discontinuities that deform the bead 30 when the normal load is placed in the pail body 12 and supported by the bail structure 34, with the normal load of a pail body having a volume of approximately 4 quarts (or approximately 4.6 liters) being about 9 lbs. (or approximately 4 kilograms).

Figure 6:
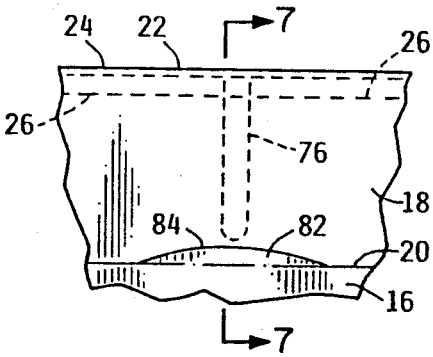
FIG. 6 is a detail side elevation view of the radially offset portion and short beveled segments of the side wall of the pail taken from line 6—6 in FIG. 1.
Figure 7:
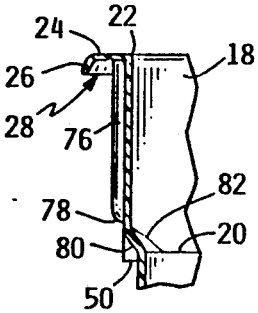
FIG. 7 is a cross section view of the radially offset portion and short beveled segments of the side wall of the pail taken through line 7—7 in FIG. 6.
Figure 4:
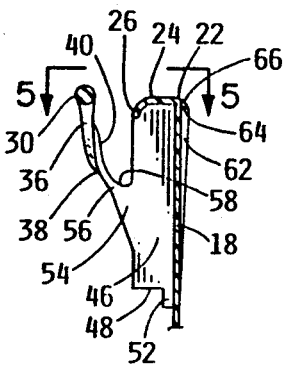
FIG. 4 is a broken away cross section view of the pail, connecting components of the bail, and ramp taken through line 4—4 of FIG. 3.
Figure 5:
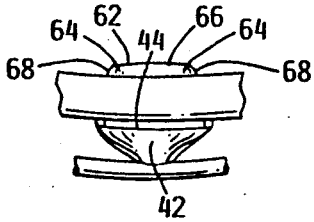
FIG. 5 is a top view of the pail, connecting components of the bail, and ramp taken from line 5—5 in FIG. 4.
Figure 8:
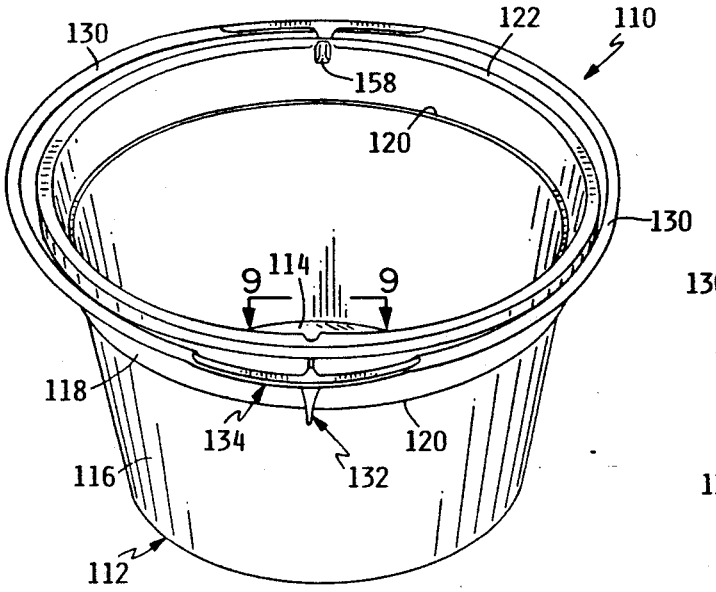
FIG. 8 is a perspective view of an alternate embodiment of the pail and bail of this invention with the handle segments of the bail disposed generally in the lowered position substantially coplanar with the rim of the pail.

Referring to FIGS. 1, 6, and 7, it may be seen that inverted ramps 62 are disposed on the inner surface of the radially offset portion 18 of the side wall 16 substantially along the height thereof. The top edge 64 of each ramp 62 is disposed slightly beneath the top edge 22 of the pail body 12, with a portion 66 of the ramp 62 curving upwardly to be flush with the top edge of the pail 22 and top surface of the horizontal top rim member 24. Each ramp 62 has a thickness along that top edge 64 of slightly greater than 0.0625" at the centerline thereof and slightly less than 0.0625" at the outer side edges 68 thereof, such that the inner surface of each ramp 62 is gently and convexly curved (the curve being shown in exaggerated proportion in FIG. 5). The thickness of each ramp 62 tapers or diminishes as the ramp 62 approaches the top edge 20 of the lower portion of the side wall 16 such that is it flush therewith at the juncture 70. The thickness of the inner surface portions 72 of the radially offset portion 18 of the side wall 16 on each side of or bracketing the ramp 62 taper in the opposite direction as the ramp 62 so as to be flush with the top edge 20 of the lower portion of the side wall 16 at the bottom thereof and flush with the inner surface of the radially offset portion 18 of the side wall 16 at the top edge thereof.

Referring to FIGS. 1 and 2, the radially offset portion 18 of the side wall 16 does not extend along the outer surface portions 74 on each side of or bracketing the connecting components 32 but rather is flush with the outer surface of the lower portion of the side wall 16, with the thickness of the radially offset portion 18 of the side wall 16 tapering inwardly to be flush with that outer surface at the top edge of the radially offset portion 18 of the side wall 16.

Again referring to FIGS. 1, 2, 6, and 7, the pail body 12 further defines six vertical ribs 76 each having a curved outer surface, a width of approximately 0.1875" or slightly less, and a thickness approximately equal to the thickness of the radially offset portion 18 of the side wall 16 at the lower edge 50 thereof. Each of the four ribs 76 most closely adjacent to one of the connecting components 32 extends the height of the radially offset portion 18 of the side wall 16, and the ribs 76 are spaced apart from one another approximately 3.1875" on center such that if eight ribs 76 were present one rib 76 would be generally centered between each pair of flange members 46.

Each of the ribs 76 located orthogonally to the connecting components 32 around the circumference of the pail body 12 are foreshortened at the lower ends 78 thereof by approximately 0.1875", with an inset segment 80 of the lower edge 50 of the radially offset portion 18 of the side wall 16 centered on those ribs 76 being inset and curving inwardly to be flush with the outer surface of the lower portion of the side wall 16. Each inset segment 80 has a width of approximately 1.25". On the inside surface of the pail body 12 opposing each of the inset segments 80 is a short beveled segment 82 which has a gently and convexly curved top edge 84 and a length substantially equal to the inset segments 80. Each short beveled segment 82 is flush with the top edge 20 of the lower portion of the side wall 16 along the bottom edge thereof, and tapers to be flush with the inner surface of the radially offset portion 18 of the side wall 16 along the top edge thereof. Each short beveled segment 82 has a height between the bottom edge and top edge thereof approximately equal to the distance by which the corresponding ribs 76 are foreshortened.

Aligned with the center of one of the connecting components 32 or short beveled segments 82 on the outside surface of the bottom 14 of the pail body 12 are four feet (not shown) which have a thickness of approximately 0.0625", a length aligned with the radius of the bottom of 0.6875", and a height of approximately 0.0625". Each of the feet is inset from the outer surface of the side wall 16 a distance of approximately 0.4375". The center of the bottom 14 defines a raised convex circular area (not shown) having a diameter of approximately 1.125" and a material thickness approximately two or more times the thickness of the side wall 16, and a height of approximately 0.125" (which presents a concave circular depression on the outside of the bottom 14 of the pail body 12.)

Figure 11:
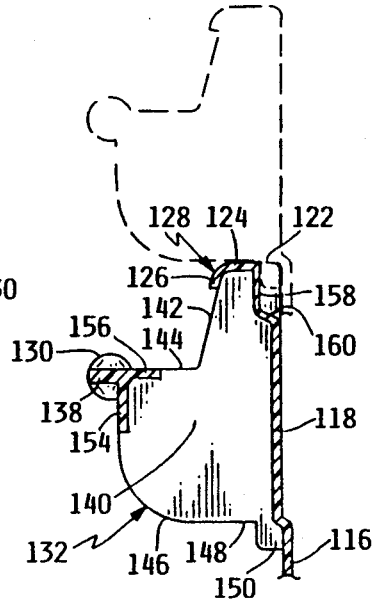
FIG. 11 is a broken away cross section view of the pail, connecting components of the bail, and ramp taken through line 11—11 of FIG. 10.
Figure 9:
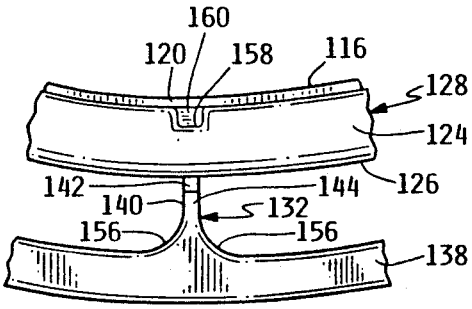
FIG. 9 is a broken away top view of the pail and connecting components of the bail taken from line 9—9 in FIG. 8.
Figure 10:
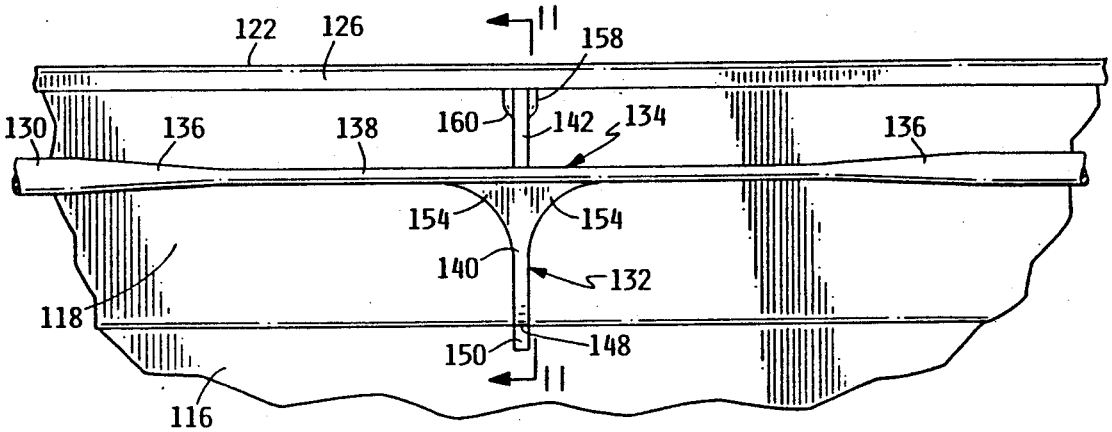
FIG. 10 is a detail side elevation view of the connecting components of the bail and adjacent portions of the pail taken from the front in FIG. 8.

Referring particularly to FIGS. 9–11, it may be seen that a second embodiment of the container 110 comprises a pail body 112 having a generally circular bottom 114, an generally upright and cylindrical side wall 116 curving upward uniformly from the bottom 114 and having a slight outward taper such that like containers 110 may be nested in a vertical column within one another, a radially offset portion 118 of the side wall 116 which is disposed radially outside and circumscribing the top edge 120 of the lower portion of the side wall 116 a distance equal to the thickness of the material forming the side wall 116 and extending vertically along approximately one quarter the total height of the side wall 116, the radially offset portion 118 being located proximate to and below the top peripheral edge 122 of the side wall 116 from which a horizontal top rim member 124 extends outwardly and a vertically depending skirt portion 126 extends downwardly a distance from the side wall 116 to form a generally circular top peripheral rim 128 of the pail body 112.

The bead 130 is connected to the side wall 116 of the pail body 112 in the region of the offset portion 118 by a single connecting component 132. The bead 130 and connecting component 132 together form a bail assembly or bail structure 134, with the bail structure 134 and pail body 112 together forming the container 110. Two connecting components 132 are disposed between the pail body 112 and bail 114 on diametrically opposing sides of the pail body 112 from one another.

Referring particularly to FIG. 10, it may be seen that the bead 130 has a generally circular cross section throughout most of its extent, narrowing gradually over a pair of uniformly tapered regions 136 to a thinner, nearly rectangular or generally oblong, flattened oval region 138 disposed adjacent to and overlapping each of the connecting components 132.

Each of the connecting components 132 includes a generally planar, vertically-oriented flange member 140 formed integrally with the side wall 116 from a point adjacent to the top edge 120 of the lower portion and extending upwardly and connected to the underside and inner sides of the horizontal top rim member 124 and a vertically depending skirt portion 126, respectively, of the top peripheral rim 128. The flange member 140 extends downwardly along an angled edge 142 and horizontally along a horizontal section 144 toward and coplanar with the top surface of the thin rectangular or flattened oval region 138 forming a generally obtuse open angle. The bottom edge 146 of the flange member 140 is arcuately curved to form a quarter radius, tangential to the approximate center of the bead 130 and to the top edge 120 of the lower portion of the side wall 116 at the lower edge 148 of the flange member 140.

Each flange member 140 defines a rectangular tab 150 located at the lower edge 148 thereof generally coplanar with the flange member 140, the tab 150 depending below the top edge 120 of the lower portion and extending outwardly from the outer surface of the side wall 116 a distance approximately twice the offset between the offset portion 118 and lower portion of the side wall 116.

Referring to FIGS. 10 and 11, it may be seen that the flange member 140 flares outwardly to define a pair of fin members 154 that are formed integrally with and extend arcuately upward and tangentially outward from the flange member 140 to the bottom surface of the thin rectangular or flattened oval region 138 of the bead 130, with the fin members 154 also extending radially inwardly from the bead 130 along arcuate lines 156 as shown in FIG. 9 to connect with and along the side surfaces of the flange member 140.

Again referring to FIGS. 8–11, it may be seen that the topmost portion of the radially offset portion 118 of the side wall 116 defines a pair of generally rectangular recesses 158, each recess being aligned with and centered along one of the flange members 140. Each recess 158 extends outwardly from the inner peripheral surface into, and downwardly from the horizontal top rim member 124 of, the top peripheral edge 122 of the top peripheral rim 128, and terminates in an angled bottom edge 160 that angles inwardly toward the adjacent side surface of the flange member 140 and toward the inner receptacle region of the pail body 112. Each recess 158 extends outwardly from the top portion 118 of the side wall 116 approximately one third to one half the overall width of the top peripheral rim 128, and downwardly from the top peripheral edge 122 approximately two to three times the overall height of the top peripheral rim 128. Two like containers 110 may be nested such that the tabs 150 of the upper container 110 are slidably received within the corresponding aligned recesses 158 of the lower container 110, thus preventing the nested containers 110 from rotating relative to one another and permitting uniform alignment of the beads 130 and connecting components 132 of each container 110 in a vertical column of stacked containers 110, and alternately preventing two containers 110 from becoming forcibly jammed when nested.

When the central handle or handgrip segments of the bead 130 are pivoted upwardly and inwardly toward one another to a position contacting one another and disposed above the open top of the pail body 112 (as shown in FIG. 2 regarding the first embodiment), the entire bead 130 or bail structure 134 will generally form a figure eight pattern. The thin rectangular or flattened oval regions 138 will flex or bend at two locations each on opposing sides of the connecting members 132, and presenting generally smooth loops at the ends or segments of the bead 130 adjacent to the connecting components 132 but without creating sharp creases or folds in the bead 130 when the normal load is placed in the pail body 112 and supported by the bail structure 134.

While the preferred embodiments of the above container 10 have been described in detail with reference to the attached drawing Figures, it is understood that various changes and adaptations may be made in the container 10 without departing from the spirit and scope of the appended claims.

What is claimed is:

1. A container molded as a unitary article from a plastic resin, the container being suitable for carrying a normal load, the container comprising:

a pail body, the pail body having a bottom and a side wall extending upwardly from the bottom to a top edge, the side wall being generally cylindrical, the pail body further having a top peripheral rim disposed along the top edge of the side wall; and a bail structure, the bail structure including a bead and at least a pair of connecting components extending between and connected to both the bead and the side wall of the pail body, the bead having a pair of handle segments disposed generally between the pair of connecting components, the bead extending around and generally circumscribing the top peripheral rim of the pail body when in a lowered position generally coplanar with or below the top peripheral rim, the bead having a circumference and a generally uniform cross-section at least throughout a substantial portion of the circumference, the bead forming a generally figure eight shape when the handle segments are lifted to a raised position disposed above the pail body with the handle segments generally proximate to one another, the figure eight having a pair of loops each disposed generally proximate to a one of the connecting components, each of said pair of connecting components including a rib member connected to and extending generally perpendicularly from said bead, said rib member having a pair of opposing sides, a widened portion, said widened portion formed integrally with and extending outwardly from said rib member on each of said pair of opposing sides thereof, said widened portion having outer edges, and a pair of flange members, each of said pair of flange members being formed integrally with and extending outwardly from the side wall of said pail body proximate to both said rib member and said widened portion, at least a portion of each of the pair of flange members being spaced apart from one another and disposed generally proximate to said outer edges of said widened portion, said widened portion being formed integrally with and connected to each of said pair of the flange members along one of said outer edges of said widened portion, whereby said pair of loops are each generally smoothly curved and said bed does not crease when the normal load is placed in the container.

2. The container of claim 1 wherein the generally uniform cross section of the bead is generally circular.

3. The container of claim 1 wherein the generally uniform cross section of the bead is circular throughout at least a pair of portions of the circumference proximate to and overlapping each of the pair of connecting components.

4. The container of claim 3 wherein the bead has a generally uniform circular cross-section throughout the circumference thereof.

5. The container of claim 1 wherein the bead has a cross-sectional diameter and the rib member has a cross-sectional diameter generally equal to the cross-sectional diameter of the bead.

6. The container of claim 1 wherein the widened portion includes a bridge member disposed beneath the bottom of the rib member, the widened portion being disposed generally between the portion of the pair of flange members which are spaced apart from one another.

7. The container of claim 6 wherein at least a first portion of the bridge member is generally parallel with the side wall of the pail body, and wherein at least a second portion of the bridge member curves generally toward the side wall of the pail body from the first portion of the bridge member.

8. The container of claim 1 wherein the widened portion is generally parallel with the side wall of the pail body, and wherein the pair of flange members extend generally perpendicular to the side wall of the pail body, and wherein a pair of connections are formed between the widened portion and the pair of flange members, the pair of connections forming at least a one quarter twist therebetween.

9. The container of claim 1 wherein the widened portion is generally parallel with the side wall of the pail body, and wherein the pair of flange members extend generally perpendicular to the side wall of the pail body, and wherein a pair of projecting members extend from the pair of flange members and are connected to the widened portion along the opposing sides of the widened portion.

10. The container of claim 9 wherein each of the projecting members has an outwardly angled edge opposing the side wall of the pail body.

11. The container of claim 1 wherein the widened portion is generally parallel with the side wall of the pail, and wherein the pair of flange members extend generally perpendicular to the side wall of the pail, and wherein a pair of connections are formed between the widened portion and the pair of flange members, the pair of connections each forming a generally upwardly concave curve.

12. The container of claim 1 wherein the rib member and the widened portion are angled generally outwardly away from vertically parallel with the side wall of the pail, such that the rib member and the widened portion will flex inwardly toward the side wall of the pail body when the normal load is placed in the pail and supported by the bail structure.

13. The container of claim 1 wherein the pair of connecting components are each angled generally outwardly away from vertically parallel with the side wall of the pail body, such that at least a portion of the pair of connecting components will flex inwardly toward the side wall of the pail body when the normal load is placed in the pail and supported by the bail structure.

14. The container of claim 1 wherein the bead has a cross section with a maximum dimension and each of the rib members has a cross section with a maximum dimension that is less than or generally equal to said maximum dimension of said cross section of the bead.

15. A container molded as a unitary article from a plastic resin, the container being suitable for carrying a normal load, the container comprising:

a pail body, the pail body having a bottom and a side wall extending upwardly from the bottom to a top edge, the side wall being generally cylindrical, the pail body further having a top peripheral rim disposed along the top edge of the side wall, said pail body defining at least one tab, said at least one tab extending from said side wall of said pail body, and wherein said to peripheral rim of said pail body defines at least one recess; and a bail structure, the bail structure including a bead and at least a pair of connecting components extending between and connected to both the bead and the side wall of the pail body, the bead having a pair of handle segments disposed generally between the pair of connecting components, the bead extending around and generally circumscribing the top peripheral rim of the pail body when in a lowered position generally coplanar with or below the top peripheral rim, the bead having a circumference and a generally uniform cross-section at least throughout a substantial portion of the circumference, the bead forming a generally figure eight shape when the handle segments are lifted to a raised position disposed above the pail body with the handle segments generally proximate to one another, the figure eight having a pair of loops each disposed generally proximate to a one of the connecting components, whereby said pair of loops are each generally smoothly curved and said bead does not crease when the normal load is placed in the container, and further whereby the at least one tab of the container will be received within the at least one recess of a like container when the container is nested within the like container.

16. The container of claim 15 wherein the at least one tab is connected to and extends from at least one of the pair of connecting components.

17. The container of claim 15 wherein the at least one tab is generally planar and extends generally vertically along the side of the wall of the pail body.

18. A container molded as a unitary article from a plastic resin, the container being suitable for carrying a normal load, the container comprising:

a pail body, the pail body having a bottom and a side wall extending upwardly from the bottom to a top edge, the side wall being generally cylindrical, the pail body further having a top peripheral rim disposed along the top edge of the side wall; and a bail structure, the bail structure including a bead and at least a pair of connecting components extending between and connected to both the bead and the side wall of the pail body, each of the pair of connecting components including a generally planar flange member extending generally perpendicularly from and vertically along the side wall of the pail body, each said planar flange member having a pair of opposing sides, each of the pair of connecting components further having a widened portion extending outwardly from each of said opposing sides of the generally planar flange member and being connected to and along a portion of the bead, the bead having a pair of handle segments disposed generally between the pair of connecting components, the bead extending around and generally circumscribing the top peripheral rim of the pail body when in a lowered position generally coplanar with or below the top peripheral rim, the bead having a circumference and a generally uniform cross-section at least throughout a substantial portion of the circumference, the bead forming a generally figure eight shape when the handle segments are lifted to a raised position disposed above the pail body with the handle segments generally proximate to one another, the figure eight having a pair of loops each disposed generally proximate to a one of the connecting components, each of said pair of connecting components including, whereby said pair of loops are each generally smoothly curved and said bead does not crease when the normal load is placed in the container.

19. The container of claim 18 wherein each of the widened portions of the connecting members form a pair of radiuses extending between each of the opposing sides of the generally planar flange member and the bead.

* * * * *